US005930953A

United States Patent [19]

Estfeller

[11] Patent Number: 5,930,953

[45] Date of Patent: Aug. 3, 1999

[54] DRIVE DEVICE FOR THE MOVABLE AND POSITIONABLE WALL MEMBERS OF A SEPARATING WALL

[76] Inventor: Herbert Estfeller, Via Cascata 18, 39040 Ora, Italy

[21] Appl. No.: 08/916,896

[22] Filed: Aug. 22, 1997

Related U.S. Application Data

[63] Continuation-in-part of application No. PCT/EP96/05628, Dec. 14, 1996.

[30] Foreign Application Priority Data

Dec. 22, 1995 [IT] Italy ..... BZ95A0080

[51] Int. Cl.[6] ..... E05D 15/26

[52] U.S. Cl. ..... 49/127; 49/130

[58] Field of Search ..... 49/125, 127, 128, 49/129, 130, 209; 160/201, 35

[56] References Cited

U.S. PATENT DOCUMENTS

| | | | |
|---|---|---|---|
| 3,341,985 | 9/1967 | Haws et al. | 49/127 |
| 5,685,355 | 11/1997 | Cook et al. | 160/201 |

FOREIGN PATENT DOCUMENTS

| | | | |
|---|---|---|---|
| 0471230 | 2/1992 | European Pat. Off. . | |
| 0574851 | 12/1993 | European Pat. Off. . | |
| 0597208 | 5/1994 | European Pat. Off. . | |
| 3147273 | 11/1991 | Germany . | |
| 403153483 | 6/1991 | Japan | 49/128 |
| 403199585 | 8/1991 | Japan | 49/127 |
| 404353186 | 12/1992 | Japan | 49/127 |
| 405005380 | 1/1993 | Japan | 49/127 |
| 405033551 | 2/1993 | Japan | 49/127 |
| 405149056 | 6/1993 | Japan | 49/127 |
| 405156864 | 6/1993 | Japan | 49/127 |
| 405156865 | 6/1993 | Japan | 49/127 |
| 406002463 | 1/1994 | Japan | 49/127 |
| 406073942 | 3/1994 | Japan | 49/127 |
| 1456283 | 11/1976 | United Kingdom | 49/127 |

*Primary Examiner*—Daniel P. Stodola
*Assistant Examiner*—Curtis A. Cohen
*Attorney, Agent, or Firm*—Horst M. Kasper

[57] ABSTRACT

Wall members (1) of a partition wall which can be assembled by roller cross-heads (1*a*, 1*b*), along a main guide rail (3–3*a*) and branch rails (3*b*, 3*c*) of displaceable wall members (1) are displaced (A, B, C) by self-propelling trolleys (2, 2*a*, 2*b*) which move inside a continuous channel provided in or on the guide rails (3–3*a*, 3*b*, 3*c*). The self-propelling trolleys (2, 2, 2*b*) have an electrical linking device (4) which acts on suspension projections (6) or recesses provided on the roller cross-heads (1*a*, 1*b*). One of the roller cross-heads (1*a*, 1*b*) of the wall members is mounted to be displaceable horizontally (1*i*), to move the sealing ledges (1*d*, 1*e*) in and out (1*f*, 1*v*) by way of a system of levers, connecting rods, and springs (1*t*, 1*p*, 1*l*, 1*n*, 1*r*, 1*o*).

27 Claims, 4 Drawing Sheets

DRIVE DEVICE FOR THE MOVABLE AND POSITIONABLE WALL MEMBERS OF A SEPARATING WALL

This application is a continuation-in-part application of another international application filed under the Patent Cooperation Treaty on Dec. 14, 1996, bearing Application No. PCT/EP96/05628, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The invention relates to a system of separating walls in a room to be subdivided.

2. Brief Description of the Background of the Invention Including Prior Art

Room-separating walls are known which are composed of a sequence of wall members which are movable and positioned on a guide rail attached to a ceiling. Furthermore, different structures are known to park the wall members of a room separating wall on the side, for example in a niche or a recess, such that the wall members, placed in sequence with the wall face, form a bundle which takes up a minimum of space. In order to achieve the storage of the wall members, it is known to furnish a branch from a main guide rail at the ceiling, for example at an angle of 90° relative to the course of the room separating wall in order to furnish a second guide rail, which extends parallel to the main guide rail, at a distance equal to the axial distance between the two load-bearing bolts with roller cross-head of the movable and positionable wall members.

There are known different drive devices for said movable and positionable wall members in order to achieve the mechanized composition of the room separating wall or, respectively, in order to achieve the bundled parking of the individual wall members. A drive device for movable and positionable wall members along a guide rail at the ceiling is known from the European printed patent document EP0, 471,230-A1, which drive device is characterized by a chain or another drive element, which drive element is supported inside of the guide rail itself and which exhibits entrainment means, which entrainment means protrude relative to the support members of the movable and positionable wall members, wherein these support members exhibit vertically adjustable pins in order to form a stop for the passing entrainment means and in order to effect, in case of fully extended pins, the carrying along of the wall member in one of the running directions of the chain. This drive system has proven to exhibit little reliable upon exchange of the roller cross-head of the movable and positionable wall members from the main guide rail to the side guide rail or onto the branch guide, in particular when these branch guides form an angle of 90° with the longitudinal direction of the main guide rail.

The European printed patent document EP-0,574,851-A1 described a drive system for movable and positionable wall members of a room separating wall, which drive system is characterized in that a coupling is furnished, which coupling is movable between the support members of the wall members and the transport chain, and which allows the coupling or, respectively, the decoupling in the branch region of the guide rail.

A control system for a drive system with a chain or another drive element is known from the German petit patent DE-G 9,209,496.1, where the drive element is supported in the guide rail for the wall members itself.

All these known solutions exhibit, however, functional interferences in particular in the branch region of the guide rails or in the regions, where the guides are running at an angle. A further disadvantage of the known systems is the noisy running of the chains and the noise of the coupling and decoupling between the entrainment means and the support members of the movable wall members as well as the rather complicated control system.

All the known systems exhibit in addition the disadvantage that they use electrically operated power drive systems in order to achieve a driving out and a driving in of the sealing ledges against the floor and against the ceiling. These known electrical drive systems presuppose an electrical connection between the individual wall members, forming the room separating wall, in order to achieve the current supply and the control of the electric motors in the interior of each wall member.

SUMMARY OF THE INVENTION

It is an object of the present invention to furnish a drive device for movable and positionable wall members of a room separating wall of the initially recited kind, which drive device operates reliably and with low noise, overcomes the branching-off regions of the guide rails without jamming and stoppage, which allows a simpler control system and which allows, in case of an interruption of power or in case of a breakdown in the drive mechanism, also the conventional manual operation.

It is another object of the invention to eliminate the electrical drive system for the actuation of the sealing ledges as well as the systems of the electrical connection between the individual wall members for the purpose of power supply and control.

These and other objects and advantages of the present invention will become evident from the description which follows.

2. Brief Description of the Invention

The present invention provides for a drive system for wall members of a room separating wall. A first guide rail extends in a substantially horizontal direction and is attached from above. A second guide rail extends in a substantially horizontal direction, is attached from above, adjoins the first guide rail, and is disposed at an angle of about 90 degrees relative to the first guide rail. A third guide rail extends in a substantially horizontal direction, is attached from above, adjoins the second guide rail, and is disposed about parallel relative to the first guide rail. A first self-propelled travelling trolley is supported and guided by the first guide rail. A second self-propelled travelling trolley is supported and guided by the second guide rail. A third self-propelled travelling trolley is supported and guided by the third guide rail. A first coupling device is attached to the first travelling trolley. A second coupling device is attached to the second travelling trolley. A third coupling device is attached to the third travelling trolley. A wall member is supportable on one of the first guide rail, the first guide rail and the second guide rail, and the first guide rail and the third guide rail. A first roller crosshead is attached to the wall member at an upper end of the wall member near a first side and engageable by each one of the coupling devices. A second roller crosshead is attached to the wall member at the upper end of the wall member near a second side and is engageable by the first coupling device. The distance of the first roller crosshead from the second roller crosshead corresponds to the distance between the first rail and the third rail. Means are provided for coupling and decoupling the first roller crosshead from the first coupling device. Means are provided for coupling and decoupling the first roller crosshead from the second coupling device. Means are provided for coupling and decoupling the first roller crosshead from the third coupling device.

A second wall member can be supported on one of the first guide rail, the first guide rail and the second guide rail, and the first guide rail and the third guide rail. A third roller crosshead can be attached to the second wall member at an upper end of the second wall member near a first side and engageable by each one of the coupling devices. A fourth roller crosshead can be attached to the second wall member at the upper end of the second wall member near a second side and engageable by the first coupling device. The distance of the first roller crosshead from the second roller crosshead can correspond to the distance between the first rail and the third rail.

A first profile can be furnished at the first guide rail for running the first self-propelled travelling trolley. A second profile can be furnished at the second guide rail for running the second self-propelled travelling trolley. A third profile can be furnished at the third guide rail for running the third self-propelled travelling trolley.

A first coupling element can be furnished at the first roller crosshead and being engageable by each of the coupling devices. A second coupling element can be furnished at the second roller crosshead and engageable by the first coupling device.

A bow can be attached to the wall member and engageable by the first coupling device.

A coupling structure can protrude from the wall member. The coupling at the roller crossheads of the wall members can be performed at the coupling structure protruding from the wall members.

A recess structure can be furnished the wall member. The coupling at the roller crossheads of the wall members can be performed at the recess structure protruding from the wall members.

A first guide channel can be furnished in the first guide rail. A second guide channel can be furnished in the second guide rail. A third guide channel can be furnished in the third guide rail. A first gear rack can be furnished in the first guide channel. A second gear rack can be furnished in the second guide channel. A third gear rack can be furnished in the third guide channel. A first gear wheel can be attached to the first self-propelled travelling trolley. A second gear wheel can be attached to the second self-propelled travelling trolley. A third gear wheel can be attached to the third self-propelled travelling trolley. A first electric motor can be attached to the first travelling trolley and be connected to the first gear wheel for driving the first gear wheel along the first gear rack. A second electric motor can be attached to the second travelling trolley and be connected to the second gear wheel for driving the second gear wheel along the second gear rack. A third electric motor can be attached to the third travelling trolley and be connected to the third gear wheel for driving the third gear wheel along the third rack.

A first current feed can be provided for the first motor. A second current feed can be provided for the second motor. A third current feed can be provided for the third motor. A first guide for the first current feed can be provided in the first guide channel for the first self-propelled travelling trolley. A second guide for the second current feed can be provided in the second guide channel for the second self-propelled travelling trolley. A third guide for the third current feed can be provided in the third guide channel for the third self-propelled travelling trolley. First sliding contacts can be disposed at the first self-propelled travelling trolley and sliding in first guide channel. Second sliding contacts can be disposed at the second self-propelled travelling trolley and sliding in second guide channel. Third sliding contacts can be disposed at the third self-propelled travelling trolley and sliding in third guide channel.

A first stop element can be furnished in the first guide channel for the first self-propelled travelling trolley, which first stop element can act on a first microswitch furnished at the first self-propelled travelling trolley. A second stop element can be furnished in the second guide channel for the second self-propelled travelling trolley, which second stop element can act on a second microswitch furnished at the second self-propelled travelling trolley. A third stop element can be furnished in the third guide channel for the third self-propelled travelling trolley, which third stop element can act on a third microswitch furnished at the third self-propelled travelling trolley.

A first coupling member can be disposed at a first end of the first self-propelled travelling trolley. A second coupling member can be disposed at a second end of the first self-propelled travelling trolley. A third coupling member can be disposed at a first end of the second self-propelled travelling trolley. A fourth coupling member can be disposed at a second end of the second self-propelled travelling trolley. A fifth coupling member can be disposed at a first end of the third self-propelled travelling trolley. A sixth coupling member can be disposed at a second end of the third self-propelled travelling trolley.

A horizontally shiftable support can be provided for the first roller cross-head of the wall member and disposed at the wall member. The sliding of the first roller cross-head during the mounting or demounting of the room separating wall can effect a moving out and a moving in, respectively, of sealing ledges.

The horizontally shiftable support performing a horizontal shifting of the first roller cross-head at the wall member can be self-inhibiting based on overcoming a dead point.

A spring can be associated with the horizontally shiftable support. The spring can effect a shifting of the first roller cross-head of the wall member into an extreme position defined by a stop.

A horizontally shiftable support can be provided for the second roller cross-head of the wall member and disposed at the wall member. The sliding of the first roller cross-head during a mounting or demounting of the room separating wall can effect a moving out and a moving in, respectively, of sealing ledges.

The horizontally shiftable support performing a horizontal shifting of the second roller cross-head at the wall member can be self-inhibiting based on overcoming a dead point.

A spring can be associated with the horizontally shiftable support. The spring can effect a shifting of the second roller cross-head of the wall member into an extreme position defined by a stop.

In accordance with the present invention there are provided self-propelled travelling trolleys within the guide rails for the support members of the wall members, which travelling trolleys perform the coupling, the moving in two directions, and the decoupling of the individual support members of the wall members for the purpose of the composition of the room separating wall or, respectively, for the purpose of the parking of the wall members in a bundled storage position. The invention further provides that the moving out and the hauling in of the sealing ledges, provided at the individual wall members, is achieved by employing the shifting motion of the wall member itself at the main guide rail.

The self-propelled travelling trolleys can run according to the invention within the guide rails, attached to the ceiling, which guide rails are furnished for the support of the movable and positionable wall members and in fact preferably in a channel which is disposed above the guide channel for the support members of the wall members, without however excluding the possibility that the travelling trolleys are running in the inside of a laterally disposed channel. The self-propelled travelling trolley comprises essentially an electric motor, an electromagnetic coupling device, running and guide rollers, a microswitch, and an electronic control card. The electric motor drives a gearwheel which engages a gear rack, where the gear rack for example is furnished in a groove within the support and guide channel for the travelling trolley. The electromagnetic coupling device comprises an electromagnet with a coupling element, which coupling element is supported by a spring in a retracted position, and which coupling element is driven out by the electromagnet for coupling. The control of the electric motor and of the electromagnet according to the invention is performed by pulses, which are furnished by one or several microswitches upon crossing over of projections or recesses. These projections or recesses are furnished at certain predetermined points along the corresponding running course in the inside of the support and guide channel. The control pulses however can also be triggered through an optical or magnetic read system. The current supply of the self-propelled travelling trolley together with the electromagnetic coupling device can be performed through a spiral-shaped cable, which is guided within the support and guide channel or by way of sliding contact.

The drive system according to the invention presupposes that a self-propelled travelling trolley is furnished in each straight-line section of the guide rails, and for this purpose three self-propelled travelling trolleys are required for example in a parking device with a branching at an angle of 90°: one travelling trolley moves along the main guide rail, a second travelling trolley moves along the branch rail, which branch rail forms an angle of 90° with the main guide rail, and a third travelling trolley moves along the guide rail which runs parallel to the main guide rail. The function of the individual self-propelled travelling trolleys is coordinated with a control program.

A logical sequence of the movement of the travelling trolleys as well as the coupling and decoupling processes is required in particular upon changing one of the support members of a wall member from the main guide rail to the rail, running parallel to the main guide rail, over the branch guide at an angle of 90°. In the example with the lateral bundling of the parked wall members and a branch guide at an angle of 90°, the following course of the motions and coupling processes is given:

a) the travelling trolley of the main guide rail couples the movable support member, facing the parking region, of the wall members and moves this support member up to the branch region of the branch guide at an angle of 90°, where a decoupling is performed in order to continue to drive then the required distance in order to allow the coupling to the travelling trolley, which travelling trolley is furnished in the branch guide;

b) the self-propelled travelling trolley of the branch guide at an angle of 90° reaches in the meantime the branching point and couples the support member, which was previously decoupled from the travelling trolley of the main guide rail in order to pull the support member into the branch guide rail until the wall member, disposed opposite the main guide rail, assumed an angled position (preferably more than 30°) in order to decouple it in the following;

c) the self-propelled travelling trolley of the main guide rail moves in order to couple the second drivable support member of the same wall member and drives support member up to the branching point, wherein simultaneously the advancing of the first support member up to the connection point at an angle of 90° between the branch guide rail and the guide rail running parallel to the main rail is performed;

d) the self-propelled travelling trolley of the guide rail, running parallel to the main guide rail, couples the first support member and pulls the wall member, in cooperation with the travelling trolley of the main guide rail, into a cross position relative to the course of the main guide rail, in the direction of the bundling region, where two travelling trolleys decouple the support members in one position, which position is determined by the wall members which have been previously stored in this region;

e) the travelling trolleys assume anew the starting positions for the shifting in the direction bundling region of the next wall member or, respectively, assume the starting position for the moving and positioning of the first wall member for the purpose of renewed composition of the room separating wall.

The drive device according to the invention is associated with the advantage of its reliable functioning, because the moving and positioning of the wall members is not associated with a relatively long transfer member (chain), which comprises a plurality of members which is associated with a considerable longitudinal change and thus function inhibitions because of the thereto mounted imprecisely operating coupling members. Furthermore, the self-propelled travelling trolleys allow a low-noise drive with extremely precise and quiet coupling and decoupling processes, which can be controlled electronically and/or through microswitches, actuated along the running course through projections, furnished along the running course.

Of course, the self-propelled travelling trolleys can operate in two directions by pulling and/or pushing the support members of the wall members. In order not to have to extend the guide rails for the purpose of reaching each function-important point on the side of the electromagnetic coupling device, the invention further provides for the use of a shiftable bow, which shiftable bow allows in particular in the bundling region to remove also the last wall members which were shifted against the wall during the storing procedure.

In order to effect the driving out and the driving in of the sealing ledges at each wall member in the floor region and in the ceiling region under the use of the shifting motion at the main guide rail, effected by the travelling trolleys, the invention further provides that the movable support member, facing the bundling region and at which the coupling mechanism of the travelling trolleys engages, is horizontally shiftably supported at the frame of the wall member such that a lever system, which is connected with the movable sealing ledges, can be actuated. It is achieved by way of said mechanical system that during the abutting of the first wall member to the locating stop, furnished for this purpose at the wall, during the construction phase of the room separating wall or, respectively, during the abutting phase of each further thereto sequentially disposed wall member, based on the arresting of the abutted wall member by further sliding by the travelling trolley at the shiftable support member, this travelling trolley drives the two sealing ledges during the horizontal shifting of the support member and blocks these sealing ledges in driven-out position by the overcoming of a dead point in the lever/pull-rod system. After the drive-out position of the sealing ledges and thus the overcoming of the dead point has been reached, then the shiftable support member assumes the outermost position of the horizontal course and thus acts opposite to the motion of the travelling trolley, whereby for example, because of the increase of the electrical resistance in the electric motor, the current supply is interrupted through a thereto sensitive switching element. Said current interruption for the electric motor can effect the decoupling of the movable support member and thereupon the renewed supply of current in order to allow thus the moving of the next following wall member.

The self-propelled travelling trolley couples the shiftable support member during the demounting phase of the room separating wall and effects by the pulling in the direction bundling region during a first moment the debolting of the wall member in that the sealing ledge is moved in and the wall member is subsequently moved. In order to assure the complete moving in of the sealing ledges, springs can be provided in the lever and pull rod system which springs, as soon as the dead point has been passed, effect the complete moving-in position of the sealing ledges as well as the assumption of the end position of the horizontally shiftable support member.

The mechanical system for the moving out and moving in of the sealing ledges of the wall members, which is effected by the pull and push motion of the self-propelled travelling trolley, coupled to the horizontally shiftable support member, can also be applied in the case of known drive devices for wall members, for example in the case of a chain drive with entrainment means or, respectively, with engagement and disengagement members.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention the following is shown.

DESCRIPTION OF INVENTION AND PREFERRED EMBODIMENT

Figure 1A:
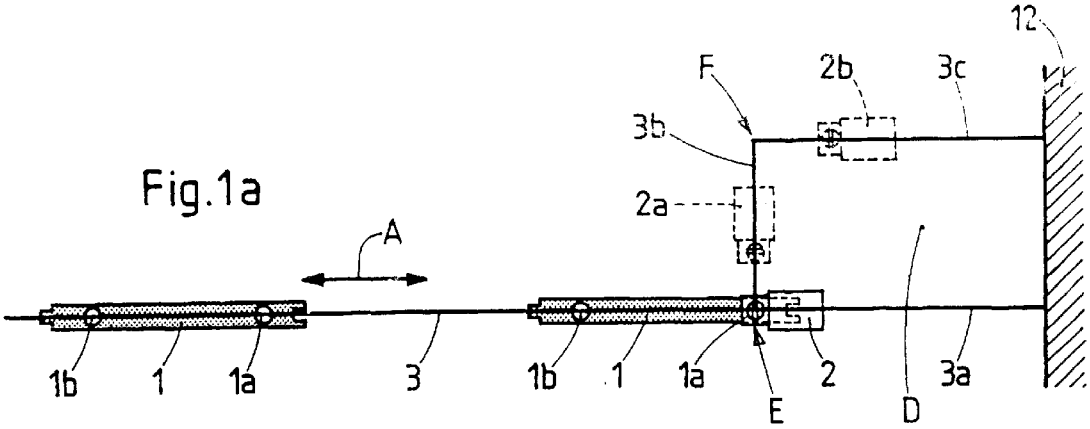
FIG. 1*a* is a schematic view of a functional scheme of a bundling plant with a branching at an angle of 90° with three self-propelled travelling trolleys at the point of reaching the branching point by the first shiftable support member of a wall member.

The present invention provides for a drive device for wall members, movable and positionable at guide rails, of a room separating wall. The moving A, B, C of the wall members 1 with at least one roller cross-head or a different support 1*a,* 1*b* along the guide rails 3–3*a,* 3*b,* 3*c* by a self-propelled travelling trolley 2, 2*a,* 2*b* is performed, which self-propelled travelling trolley 2, 2*a,* 2*b* runs inside of the same guide profile or inside of profiles, built laterally of this profile or above to the roller cross-heads 1*a,* 1*b* of the wall members 1. The self-propelled travelling trolley 2, 2*a,* 2*b* exhibits at least one coupling device 4, which coupling device 4 acts immediately onto the roller cross-heads 1*a,* 1*b* or on the coupling elements 6, 7*a,* which are furnished at the roller cross-heads 1*a,* 1*b* and/or at bows 7, which are shiftable between the roller cross-heads.

The coupling at the roller cross-heads 1*a,* 1*b* of the wall members 1 can be performed at elements protruding from the wall members 1 or by way of recesses furnished at the wall members 1.

A gear rack 8*a* can be furnished in the same support and guide channel for the self-propelled travelling trolley 2, 2*a,* 2*b.* A gear wheel 2*c,* driven by the electric motor of the travelling trolley, can engage into the gear rack 8*a.*

A guide for the current feed and/or for conductors, at which sliding contacts are sliding, can be provided in the same channel for the self-propelled travelling trolley 2, 2*a,* 2*b.*

Stop elements 9 can be furnished in the same channel for the self-propelled travelling trolley, which stop elements 9 can act on one or several microswitches, furnished at the travelling trolley.

The electromagnetic coupling device 4, which can be furnished at the self-propelled travelling trolley 2, 2*a,* 2*b,* can be an individual device with a single coupling member 5 or with two coupling members or an individual device with two coupling members 5, which coupling members 5 can be placed at two ends of the travelling trolley, or a double device with two electromagnets with two coupling members, operating independently of each other at the ends of the travelling trolleys.

The control of the motor of the travelling trolley and/or the control of the coupling device 4 can be performed by the use of mechanical, magnetic and/or optical sensors, by the use of the current feed itself, and/or by its own conductors, which can be directly connected or at which sliding contacts can be sliding.

One of the roller cross-heads 1*a,* 1*b* of the wall members 1 can be horizontally shiftably 1*i* supported 1*g,* 1*h* at the wall member 1. The sliding of this roller cross-head 1*a* during the mounting or demounting of the room separating wall can effect, by interaction of the self-propelled travelling trolleys 2 or of known shifting means, the moving out or, respectively, the moving in 1*f,* 1*v* of the sealing ledges 1*d,* 1*e.*

The mechanism, which uses the horizontal shifting 1*i* of the roller cross-head 1*a* at the wall member 1, in particular for the moving-out position of the sealing ledges, can be self-inhibiting, and wherein this can be achieved by overcoming a dead point.

The moving in of the sealing ledges 1*d,* 1*e* based on the overcoming of a dead point in the drive mechanism, the following moving-in motion by the effect of one or several springs, without requiring a further acting driving force at the roller cross-head 1*a*, can be achieved, and wherein the effect of these springs in addition can effect the shifting of the roller cross-head 1*a* of the wall member in an extreme position, defined by a stop.

The guide and slide rails 8 comprise an upper channel for the displacement A, B, C of the self-propelled travelling trolleys 2, 2*a,* 2*b* and a lower channel for the guiding of the support members with roller cross-head 1*a* and 1*b* of the wall members 1 and form a main guide rail 3–3*a,* which determine the course of the room separating wall and which is mounted at the ceiling. A branch guide 3*b* is furnished at an angle of 90° extending in a direction parallel to the bundling region D of the wall members 1, which branch guide rail 3*b* is continued in a secondary guide rail 3*c,* and which secondary guide rail runs parallel to the main guide rail 3–3*a*. The branch guide rail 3*b* extends over the same length as the axial distance between the support members 1*a*, 1*b* of the wall members 1.

Figure 1B:
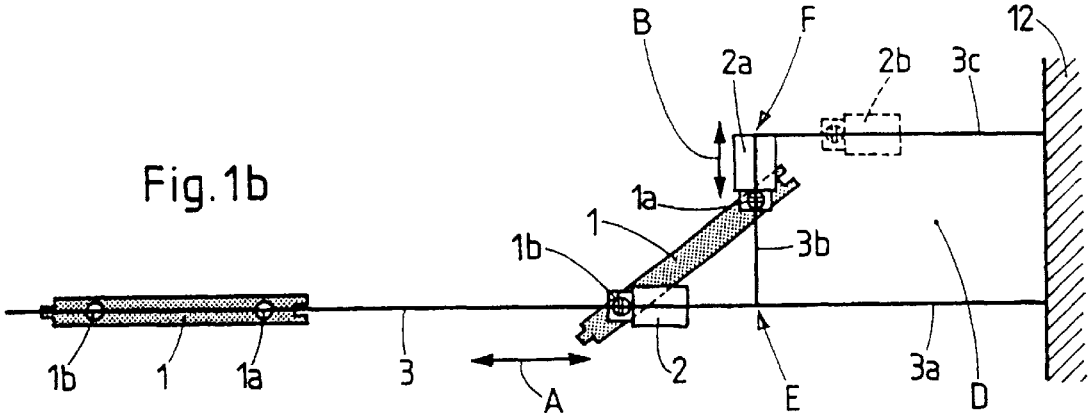
FIG. 1*b* shows the same system illustrated in FIG. 1*a,* however, with the wall member in the phase of the changing over to the branch rail and in a position of an angle relative to the main guide rail.
Figure 1C:
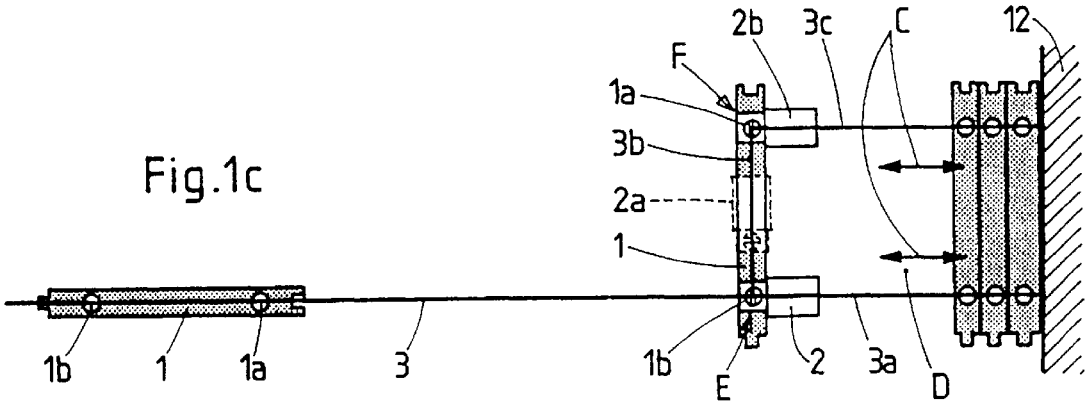
FIG. 1*c* shows the same system illustrated in FIGS. 1*a* and 1*b,* however, with three wall members already in the bundling region stored and with a wall member with a support member disposed at the branching point of the branch rail from the main guide rail and the second support member in the transition point of the branch rail into the rail, running parallel to the main guide rail, and with two respective self-propelled travelling trolleys coupled at the support members.
Figure 2:
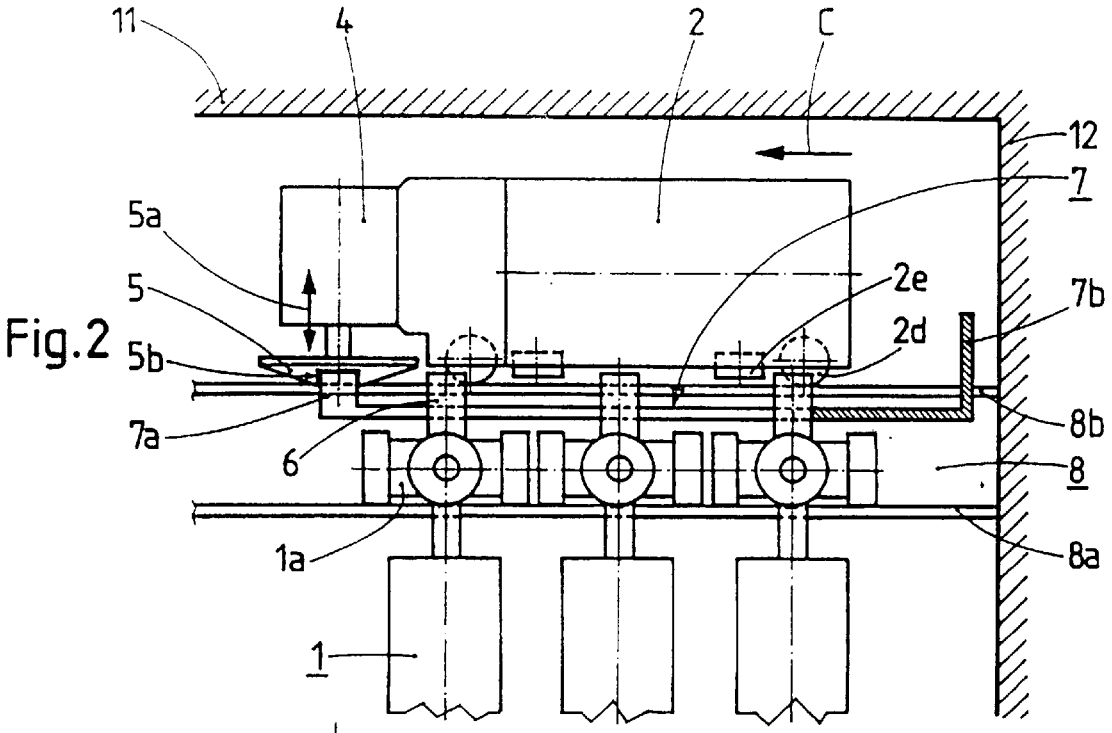
FIG. 2 shows a side elevational view of the self-propelled travelling trolley with removal bows upon removal of the wall members from the bundling region.
Figure 3:
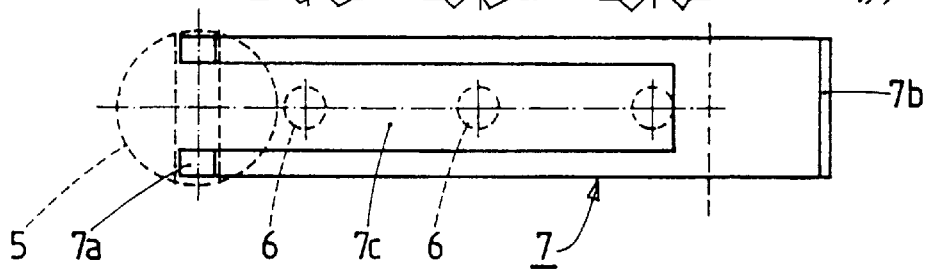
FIG. 3 is a top planar view onto the removal bow with indication of the coupling bolts at the movable support member of the wall member and the coupling disk of the travelling trolley.
Figure 4:
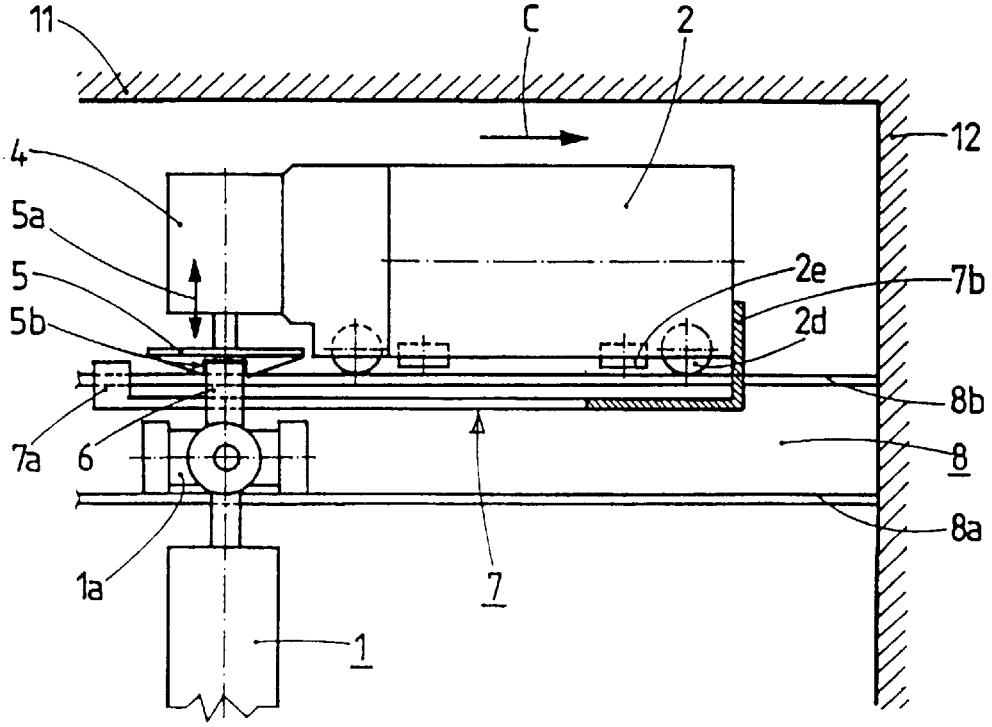
FIG. 4 shows the self-propelled travelling trolley in a side elevational view during the placing of the first wall member in the bundling region while simultaneously positioning of the removal bow into the removal position.
Figures 5, 6:
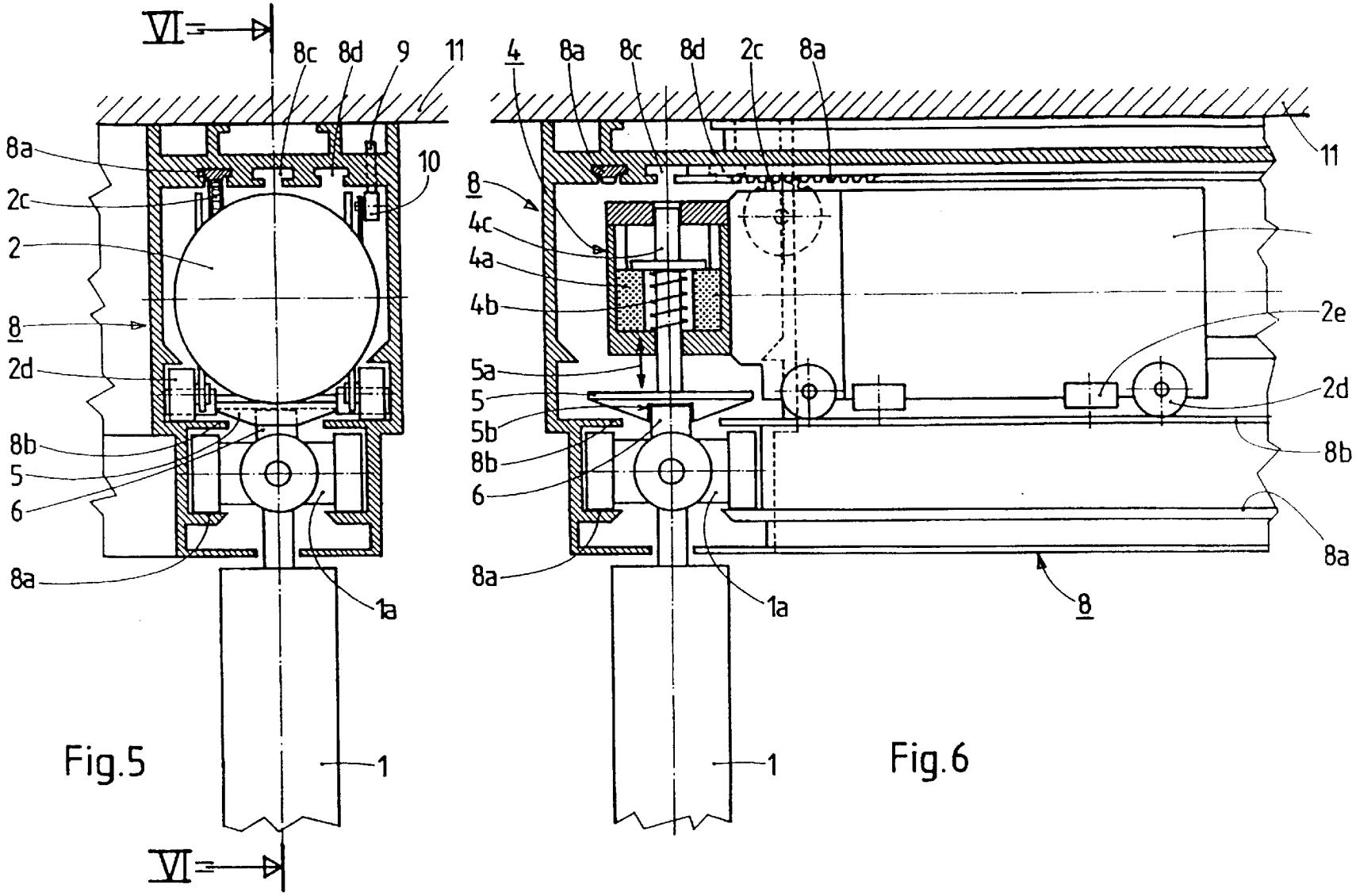
FIG. 5 shows a cross-sectional view through the main guide rail in the neighborhood of the branch rail with the self-propelled travelling trolley and the support member of a wall member positioned in the branching point.
FIG. 6 shows the cross-section of the section plane VI—VI marked in FIG. 5.

The profiles 8 (FIG. 2), which form the guides 3–3*a,* 3*b,* 3*c* in the slide channel for the roller cross-heads 1*a*, 1*b*, exhibit support flanges 8*a,* whereas flanges 8*b* are provided in the support and guide channel for the self-propelling travelling trolleys 2, 2*a,* 2*b,* where the rollers 2*d* of the travelling trolleys 2, 2*a,* 2*b* run on the flanges 8*b*. Several grooves are furnished at the top side in the same channel, which grooves serve for the insertion of the gear rack 8*a,* wherein the gear wheel 2*c* (FIG. 5) of the electrically operated travelling trolley engages into said gear rack 8*a*. Elements for the support and guiding of the elicoidal current cable can slide in the center groove 8*c* (FIGS. 5 and 6) and or elements can be employed in the center groove 8*c,* which elements trigger control pulses when the travelling trolley 2, 2*a,* 2*b* passes by. Further control elements or elements for the current supply, such as for example conductor paths at which sliding contacts glide, can be inserted into the groove or flange 8*b*. Protruding elements 9 can be placed in the inside of the same channel, which elements 9 are suitable to actuate one or several microswitches mounted an the travelling trolley 2 when the travelling trolley moves past the protruding elements 9. Said travelling trolley 2 is furnished with rollers 2*d* and 2*e* and exhibits an electromagnetic coupling device 4, which coupling device 4 in turn comprises a magnetic coil 4*a,* wherein the bolt 4*c* runs axially in the magnetic coil 4*a,* wherein the coupling plate 5 with cross groove 5*b* is moved 5*a* by way of bolt 4*c*. This cross groove corresponds to the diameter of the engagement bolts 8*b,* which engagement bolts 8*b* are furnished at the top side of the roller cross-heads 1*a*, 1*b* of the wall members 1, as well as to the length of the engagement projections 7*a* at the removal bows 7. The coupling plate 5 is brought into engagement by the magnetic force of the magnetic coil 4*a* and is maintained in engagement, while the lifted-up position of the decoupling is achieved and maintained by a spiral spring 4*b* (FIG. 6) at the bolt 4*c*. The shifting of the movable wall member 1 during the bundling phase in the corresponding region D is performed by the employment of the self-propelled travelling trolleys 2, 2*a,* 2*b,* which are furnished in the corresponding guide profiles 3–3*a,* 3*b,* 3*c* (FIG. 1). The travelling trolley 2 moves in the direction A (FIGS. 1 and 2) in order to couple 5*a* (FIGS. 2 and 4) at the bolt 1*a* of the wall member 1, facing the bundling region D, and in order to move this wall member 1 to the branch point E of the guide rail 3*b* at an angle of 90° relative to the main guide rail 3 (FIG. 1*a*). The travelling trolley 2 decouples 5*a* the bolt 6 of the roller cross-head 1*a* at the said point E and moves somewhat further in order to allow the coupling at the same bolt 6 by the travelling trolley 2*a* of the branch guide rail 3*b*. After performed coupling, the travelling trolley 2*a* moves the roller cross-head 1*a* in direction B (FIG. 1*b*) in the branch guide 3*b* and the wall member 1 is positioned at an inclined angle (FIG. 1*b*) relative to the latter rail 3, which wall member 1 together with the second roller cross-head 1*b* still runs in the main guide rail 3. As soon as this inclined position exhibits a minimum value, which allows a moving by pushing at the second roller cross-head 1*b,* then the travelling trolley 2*a* decouples and the travelling trolley 2 couples the roller cross-head 1*b* again in order to further transport the roller cross-head 1*b* in the direction A up to the branching point E, without decoupling the roller cross-head 1*b* in this position. In the following, the travelling trolleys 2*b* drives up to the point F, where the branch guide rail 3*b,* forming an angle of 90°, joins into the side rail 3*c,* which side rail 3*c* runs parallel to the main guide rail 3–3*a,* in order to couple the roller cross-head 1*a*. After performed coupling, the two travelling trolleys 2, 2*a* synchronously move the wall member in the direction of the bundling region D (FIG. 1*c*). This first wall member 1 is decoupled by the travelling trolleys 2, 2*a* in the bundling region D and at a distance to the wall 12, which distance corresponds approximately to the distance between the vertical axis of the coupling disk 5 and the opposite end of the travelling trolley. The following wall members 1, which are moved by the travelling trolleys 2, 2*b* in this same position, effect that the previously at this point decoupled wall members 1 are shifted in the direction of the wall 12, wherein the distance to this wall 12 is determined by the removal bow 7 (FIGS. 2 and 4), which removal bow 7 rests at the wall 12 (FIG. 4) during the storing of the first wall member 1 in the bundling region D upon impact by the vertical wall 7*b*. During the removal of the wall member 1 from the bundling region D, this removal bow 7 allows a certain number of the wall members, stored close to the wall 12, to be brought into a region, reachable by the electromagnetic coupling device 4.

The sequence of the motions for the renewed composition of the room separating wall is inverse to that for the storing of the wall members in the bundling region D in a practical situation.

Of course, the self-propelled travelling trolleys 2, 2*a*, 2*b* can be furnished with sensors which, for example, respond to magnetic, optical and/or mechanical pulses in order to control the motor and the coupling device.

Figure 7:
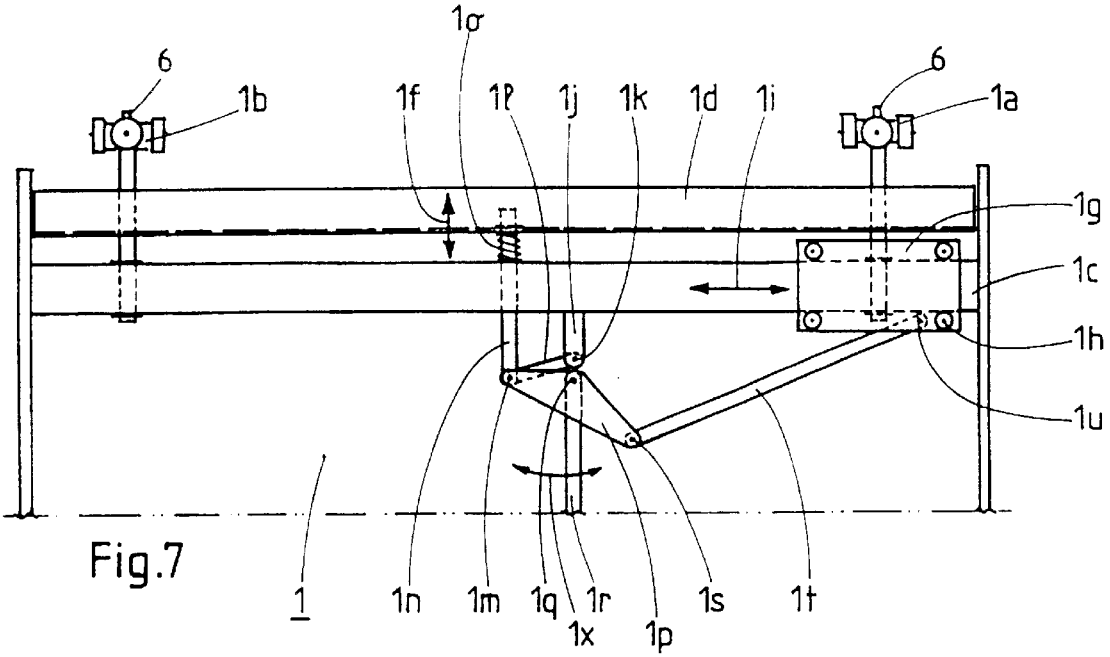
FIG. 7 shows a schematic representation of the drive mechanism for the sealing ledges of a wall member with the horizontally shiftable support member in an outermost position close to the edge and the sealing ledges in pulled-in position.
Figure 8:
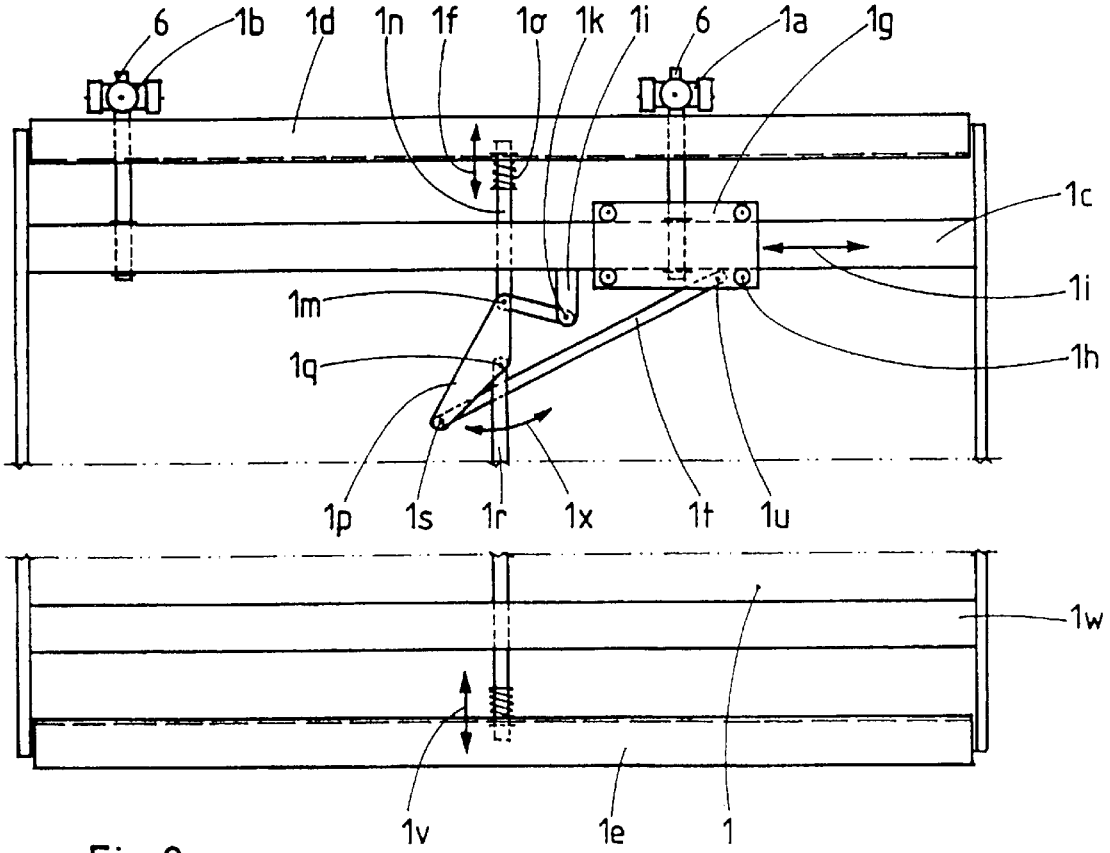
FIG. 8 is a schematic representation of the drive mechanism for the sealing ledges of a wall member with the horizontally shiftable support member in an outermost position based on approaching the second support member and with the driven-out sealing ledges.

FIGS. 7 and 8 show an exemplified embodiment in order to achieve the moving out and moving in 1*f*, 1*v* (FIG. 8) of the sealing ledges 1*d* (FIG. 7), 1*e* (FIG. 8) of a wall member 1, wherein a self-propelled travelling trolley 2 acts on the bolt 6 of the roller cross-head 1*a*, horizontally shiftable 1*i* at the cross support 1*c* of the frame of the wall member 1. During the positioning phase of the wall member 1 at the therefore furnished stop or at a previously positioned wall member, for the purpose of joining together the room separating wall, the self-propelled travelling trolleys 2, 2*b* continue to push against this stop or against said wall members, whereby the shifting 1*i* of the bearing plate 1*g* with rollers 1*h* and together with the roller crosshead 1*a*, is effected along the horizontal cross support 1*c*. The shifting 1*i* is transferred by way of the connecting rod 1*t*, which connecting rod 1*t* is hinged with one end in 1*u* at the support plate 1*g* and with the other end in 1*s* at an end of the lever 1*p*, onto the lever 1*p* with a rotary bearing 1*q* at the end of the pull rod 1*r* for the lower sealing ledge 1*e*. The shifting of the connecting rod 1*t* effects a rotation 1*x* of the lever 1*p* around the rotary bearing 1*q*, whereby the driving out 1*f* of the upper sealing ledge 1*d* by means of the pull rod 1*n* is effected, wherein the pull rod 1*n* is hinged in 1*m* at the opposite end of the lever 1*p* and shifting the connecting rod. It effects simultaneously also the driving out 1*v* of the lower sealing ledge 1*e* by means of the pull rod 1*r*. The oppositely directed motions 1*f*, 1*v* of the pull rods 1*n*, 1*r*, which are connected with the sealing ledges 1*d*, 1*e*, are guided with arm 11 and stabilized against force components. This arm is in 1*m*, together with the pull rod 1*n*, hinged at one end of the lever 1*p*, while the same arm 1*p* is hinged with its opposite end in 1*k* at the fixed bearing 1*j*, which fixed bearing 1*j* is aligned in case of moved-in sealing ledges (FIG. 7) approximately with the pull rod 1*r*. In case of moved-out sealing ledges 1*d*, 1*e*, however, the end of the pull rod 1*r* aligns approximately with the hinge 1*q* with the pull rod 1*n*, which assumes this position based on surpassing a dead point, which dead point is determined by the alignment between the axis of the pull rod 1*r* and the two hinge points 1*m*, 1*s* at the lever 1*p*. The overcoming of said dead point assures the maintenance of the move-out position of the sealing ledges 1*d*, 1*e* in case of an arrested wall member forming the room separating wall. In order to achieve the moving in of the sealing ledges 1*d*, 1*e* and thus the debolting of the wall member 1, the self-propelled travelling trolley, coupled to the shiftable roller cross-head 1*a*, acts in opposite direction in order to effect thereby the shifting 1*i* of the bearing plate 1*g* away from the roller cross-head 1*b* up to a predetermined stop. According to the invention, the operating mechanism for the sealing ledges 1*d*, 1*e* can include one or several springs which are suitable to continue the complete moving-in of the sealing ledges automatically by the spring action up to the stop as soon as the dead point is overcome. The moving-in mechanism and the moving-out mechanism according to the invention can also be employed in conventional drive mechanisms (pull chain) for the wall members, movable at the ceiling guide.

It will be understood that each of the elements described above, or two or more together, may also find a useful application in other types of drive device differing from the types described above.

While the invention has been illustrated and described as embodied in the context of a drive device for the movable and positionable wall members of a separating wall, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A movable wall system comprising a first suspended guide rail extending in a substantially horizontal direction;

a second suspended guide rail extending in a substantially horizontal direction, adjoining the first suspended guide rail, and disposed at an angle of about 90 degrees relative to the first suspended guide rail;

a third suspended guide rail extending in a substantially horizontal direction, adjoining the second suspended guide rail, and disposed substantially parallel relative to the first suspended guide rail;

a first guide channel furnished in the first suspended guide rail;

a second guide channel furnished in the second suspended guide rail;

a third guide channel furnished in the third suspended guide rail;

a first self-propelled travelling trolley supported and guided by the first suspended guide rail;

a second self-propelled travelling trolley supported and guided by the second suspended guide rail;

a third self-propelled travelling trolley supported and guided by the third suspended guide rail;

first sliding contacts disposed at the first self-propelled travelling trolley and sliding in first guide channel;

second sliding contacts disposed at the second self-propelled travelling trolley and sliding in second guide channel;

third sliding contacts disposed at the third self-propelled travelling trolley and sliding in third guide channel;

a first coupling device attached to the first travelling trolley;

a second coupling device attached to the second travelling trolley;

a third coupling device attached to the third travelling trolley;

a movable wall member supportable on one of the first suspended guide rail, the first suspended guide rail and the second suspended guide rail, and the first suspended guide rail and the third suspended guide rail;

a first roller crosshead attached to the movable wall member at an upper end of the movable wall member near a first side and engageable by each one of the coupling devices;

a second roller crosshead attached to the movable wall member at the upper end of the movable wall member near a second side and engageable by the first coupling device, wherein the distance of the first roller crosshead from the second roller crosshead corresponds to the distance between the first rail and the third rail;

means for coupling and decoupling the first roller cross-head from the first coupling device;

means for coupling and decoupling the first roller crosshead from the second coupling device;

means for coupling and decoupling the first roller crosshead from the third coupling device.

2. The movable wall system according to claim 1, further comprising a second movable wall member supportable on one of the first suspended guide rail, the first suspended guide rail and the second suspended guide rail, and the first suspended guide rail and the third suspended guide rail;

a third roller crosshead attached to the second movable wall member at an upper end of the second movable wall member near a first side and engageable by each one of the coupling devices;

a fourth roller crosshead attached to the second movable wall member at the upper end of the second movable wall member near a second side and engageable by the first coupling device, wherein the distance of the first roller crosshead from the second roller crosshead corresponds to the distance between the first rail and the third rail.

3. The movable wall system according to claim 1, further comprising a first support profile furnished at the first suspended guide rail for running the first self-propelled travelling trolley;

a second support profile furnished at the second suspended guide rail for running the second self-propelled travelling trolley;

a third support profile furnished at the third suspended guide rail for running the third self-propelled travelling trolley.

4. The movable wall system according to claim 1, further comprising a first coupling element furnished at the first roller crosshead and being engageable by each of the coupling devices; and a second coupling element furnished at the second roller crosshead and engageable by the first coupling device.

5. The movable wall system according to claim 1, further comprising a bow attached to the movable wall member and engageable by the first coupling device.

6. The movable wall system according to claim 1, further comprising a coupling structure protruding from the movable wall member, wherein the coupling at the roller crossheads of the movable wall members can be performed at the coupling structure protruding from the movable wall members.

7. The movable wall system according to claim 1, further comprising a recess structure furnished the movable wall member, wherein the coupling at the roller crossheads of the movable wall members can be performed at the recess structure protruding from the movable wall members.

8. The movable wall system according to claim 1, further comprising a first gear rack furnished in the first guide channel;

a second gear rack furnished in the second guide channel;

a third gear rack furnished in the third guide channel;

a first gear wheel attached to the first self-propelled travelling trolley;

a second gear wheel attached to the second self-propelled travelling trolley;

a third gear wheel attached to the third self-propelled travelling trolley;

a first electric motor attached to the first travelling trolley and connected to the first gear wheel for driving the first gear wheel along the first gear rack;

a second electric motor attached to the second travelling trolley and connected to the second gear wheel for driving the second gear wheel along the second gear rack;

a third electric motor attached to the third travelling trolley and connected to the third gear wheel for driving the third gear wheel along the third rack.

9. The movable wall system according to claim 8, further comprising a first current feed for the first motor;

a second current feed for the second motor;

a third current feed for the third motor;

a first guide for the first current feed provided in the first guide channel for the first self-propelled travelling trolley;

a second guide for the second current feed provided in the second guide channel for the second self-propelled travelling trolley;

a third guide for the third current feed provided in the third guide channel for the third self-propelled travelling trolley.

10. The movable wall system according to claim 8, further comprising a first stop element furnished in the first guide channel for the first self-propelled travelling trolley, which first stop element acts on a first microswitch furnished at the first self-propelled travelling trolley;

a second stop element furnished in the second guide channel for the second self-propelled travelling trolley, which second stop element acts on a second microswitch furnished at the second self-propelled travelling trolley;

a third stop element furnished in the third guide channel for the third self-propelled travelling trolley, which third stop element acts on a third microswitch furnished at the third self-propelled travelling trolley.

11. The movable wall system according to claim 1, further comprising a first coupling member disposed at a first end of the first self-propelled travelling trolley;

a second coupling member disposed at a second end of the first self-propelled travelling trolley;

a third coupling member disposed at a first end of the second self-propelled travelling trolley;

a fourth coupling member disposed at a second end of the second self-propelled travelling trolley;

a fifth coupling member disposed at a first end of the third self-propelled travelling trolley;

a sixth coupling member disposed at a second end of the third self-propelled travelling trolley.

12. A movable wall system comprising a first suspended guide rail extending in a substantially horizontal direction;

a second suspended guide rail extending in a substantially horizontal direction, adjoining the first suspended guide rail, and disposed at an angle of about 90 degrees relative to the first suspended guide rail;

a third suspended guide rail extending in a substantially horizontal direction, adjoining the second suspended guide rail, and disposed about parallel relative to the first suspended guide rail;

a first self-propelled travelling trolley supported and guided by the first suspended guide rail;

a second self-propelled travelling trolley supported and guided by the second suspended guide rail;

a third self-propelled travelling trolley supported and guided by the third suspended guide rail;

a first coupling device attached to the first travelling trolley;

a second coupling device attached to the second travelling trolley;

a third coupling device attached to the third travelling trolley;

a movable wall member supportable on one of the first suspended guide rail, the first suspended guide rail and the second suspended guide rail, and the first suspended guide rail and the third suspended guide rail;

a first roller crosshead attached to the movable wall member at an upper end of the movable wall member near a first side and engageable by each one of the coupling devices;

a second roller crosshead attached to the movable wall member at the upper end of the movable wall member near a second side and engageable by the first coupling device, wherein the distance of the first roller crosshead from the second roller crosshead corresponds to the distance between the first rail and the third rail;

means for coupling and decoupling the first roller cross-head from the first coupling device;

means for coupling and decoupling the first roller cross-head from the second coupling device;

means for coupling and decoupling the first roller cross-head from the third coupling device;

a horizontally shiftable support for the first roller cross-head of the movable wall member and disposed at the movable wall member, and wherein the sliding of the first roller cross-head during the mounting or demounting of the room separating wall effects a moving out and a moving in, respectively, of sealing ledges.

13. The movable wall system according to claim 12, wherein the horizontally shiftable support performing a horizontal shifting of the first roller cross-head at the movable wall member is self-inhibiting based on overcoming a dead point.

14. The movable wall system according to claim 12, further comprising a spring associated with the horizontally shiftable support, wherein the spring effects a shifting of the first roller cross-head of the movable wall member into an extreme position defined by a stop.

15. A movable wall system comprising a first suspended guide rail extending in a substantially horizontal direction;

a second suspended guide rail extending in a substantially horizontal direction, adjoining the first suspended guide rail, and disposed at an angle of about 90 degrees relative to the first suspended guide rail;

a third suspended guide rail extending in a substantially horizontal direction, adjoining the second suspended guide rail, and disposed about parallel relative to the first suspended guide rail;

a first self-propelled travelling trolley supported and guided by the first suspended guide rail;

a second self-propelled travelling trolley supported and guided by the second suspended guide rail;

a third self-propelled travelling trolley supported and guided by the third suspended guide rail;

a first coupling device attached to the first travelling trolley;

a second coupling device attached to the second travelling trolley;

a third coupling device attached to the third travelling trolley;

a movable wall member supportable on one of the first suspended guide rail, the first suspended guide rail and the second suspended guide rail, and the first suspended guide rail and the third suspended guide rail;

a first roller crosshead attached to the movable wall member at an upper end of the movable wall member near a first side and engageable by each one of the coupling devices;

a second roller crosshead attached to the movable wall member at the upper end of the movable wall member near a second side and engageable by the first coupling device, wherein the distance of the first roller crosshead from the second roller crosshead corresponds to the distance between the first rail and the third rail;

means for coupling and decoupling the first roller cross-head from the first coupling device;

means for coupling and decoupling the first roller cross-head from the second coupling device;

means for coupling and decoupling the first roller cross-head from the third coupling device;

a horizontally shiftable support for the second roller cross-head of the movable wall member and disposed at the movable wall member, and wherein the sliding of the first roller cross-head during a mounting or demounting of the room separating wall effects a moving out and a moving in, respectively, of sealing ledges.

16. The movable wall system according to claim 15, wherein the horizontally shiftable support performing a horizontal shifting of the second roller cross-head at the movable wall member is self-inhibiting based on overcoming a dead point.

17. The movable wall system according to claim 15, further comprising a spring associated with the horizontally shiftable support, wherein the spring effects a shifting of the second roller cross-head of the movable wall member into an extreme position defined by a stop.

18. A movable wall system including wall members, movable and positionable along guide rails, of a room separating wall, wherein the wall members (1) are moved in a direction (A, B, C) with at least one roller cross-head (1*a*, 1*b*) along the guide rails (3–3*a*, 3*b*, 3*c*) by a self-propelled travelling trolley (2, 2*a*, 2*b*), which self-propelled travelling trolley (2, 2*a*, 2*b*) runs inside of a guide profile and wherein the self-propelled travelling trolley (2, 2*a*, 2*b*) exhibits at least one coupling device (4), which coupling device (4) acts immediately onto at least one roller cross-head (1*a*, 1*b*) and on at least one coupling element (6, 7*a*), which is furnished at the roller cross-head (1*a*, 1*b*), wherein the coupling device is an electromagnetic coupling device, which is furnished at the self propelled traveling trolley (2, 2*a*, 2*b*).

19. The movable wall system according to claim 18, further comprising a coupling structure protruding from the wall members (1);

wherein the wall members (1) are coupled to the roller cross-heads (1*a*, 1*b*) at the coupling structure.

20. The movable wall system according to claim 18, further comprising a gear rack (8*a*) furnished in a same support and guide channel for the self-propelled travelling trolley (2, 2*a*, 2*b* ) wherein;

a gear wheel (2*c*) driven by an electric motor of the self-propelled travelling trolley and engaging into the gear rack (8*a*).

21. The movable wall system according to claim 18, further comprising a guide for a current feed provided in a same support and guide channel for the self-propelled travelling trolley (2, 2*a*, 2*b*).

22. The movable wall system according to claim 18, further comprising stop elements (9) furnished in a same support and guide channel for the self-propelled travelling trolley, which stop elements (9) act on at least one microswitch, furnished at the self-propelled travelling trolley.

23. The movable wall system according to claim 18, wherein the coupling device (4) is an individual device with at least one coupling member (5).

24. The movable wall system according to claim 18, wherein a control of a motor of the self-propelled travelling trolley and a control of the coupling device (4) is performed by use of sensors.

25. The movable wall system according to claim 18, wherein one of the roller cross-heads (1*a*, 1*b*) of the wall members (1) is horizontally shiftably (1*i*) supported (1*g*, 1*h*) at the wall member (1), and wherein a sliding of this roller cross-head (1*a*) during mounting or demounting of the movable wall system effects, by interaction of the self-propelled travelling trolleys (2), a moving out and moving in (1*f*, 1*v*) of sealing ledges (1*d*, 1*e*).

26. The movable wall system according to claim 25, wherein a mechanism, which uses the horizontal shifting (1*i*) of the roller cross-head (1*a*) at the wall member (1), for a moving-out position of the sealing ledges, is self-inhibiting, and wherein this is achieved by overcoming a dead point.

27. The movable wall system according to claim 25, wherein during the moving in of the sealing ledges (1*d*, 1*e*) based on an overcoming of a dead point in a drive mechanism, a following moving-in motion by an effect of at least one spring, without requiring a further acting driving force at the roller cross-head (1*a*), is achieved, and wherein the effect of the at least one spring in addition effects a shifting of the roller cross-head (1*a*) of the wall member in an extreme position, defined by a stop.

* * * * *